US009366488B2

(12) United States Patent
Sanhaji

(10) Patent No.: US 9,366,488 B2
(45) Date of Patent: Jun. 14, 2016

(54) DEVICE, METHOD AND KIT FOR CLEANING PASSAGE DUCTS OF A COOLANT FLUID IN A RECOVERY AND DEPURATION APPARATUS

(75) Inventor: Rahhali Sanhaji, Sesto Fiorentino (IT)

(73) Assignee: SNAP-ON CLIMATE SOLUTIONS S.R.L., Correggio (IT)

( * ) Notice: Subject to any disclaimer, the term of this patent is extended or adjusted under 35 U.S.C. 154(b) by 0 days.

(21) Appl. No.: 13/883,049

(22) PCT Filed: Nov. 7, 2011

(86) PCT No.: PCT/IB2011/054963

§ 371 (c)(1),
(2), (4) Date: May 2, 2013

(87) PCT Pub. No.: WO2012/059901

PCT Pub. Date: May 10, 2012

(65) Prior Publication Data

US 2013/0284277 A1 Oct. 31, 2013

(30) Foreign Application Priority Data

Nov. 6, 2010 (IT) ..... PI2010A0126

(51) Int. Cl.

| | |
|---|---|
| ***B08B 7/04*** | (2006.01) |
| ***B08B 9/027*** | (2006.01) |
| ***F25B 45/00*** | (2006.01) |
| ***A23L 3/36*** | (2006.01) |
| ***B08B 3/00*** | (2006.01) |
| ***F16K 3/36*** | (2006.01) |
| ***F28F 19/01*** | (2006.01) |

(52) U.S. Cl.

CPC ..... *F28F 19/01* (2013.01); *F25B 45/00* (2013.01); *F25B 2345/001* (2013.01); *F25B 2345/002* (2013.01); *F25B 2345/0052* (2013.01); *F25B 2400/18* (2013.01); *Y10T 137/0402* (2015.04); *Y10T 137/4238* (2015.04)

(58) Field of Classification Search

None

See application file for complete search history.

(56) References Cited

U.S. PATENT DOCUMENTS

2009/0188263 A1 * 7/2009 Murray et al. ..... 62/77

FOREIGN PATENT DOCUMENTS

WO WO8905428 * 6/1989 ..... F25B 43/00

* cited by examiner

*Primary Examiner* — Eric Golightly
*Assistant Examiner* — Arlyn I Rivera-Cordero
(74) *Attorney, Agent, or Firm* — Ladas & Parry LLP

(57) ABSTRACT

An apparatus for recovering and depurating a cooling fluid having at least one passage duct of cooling fluid that extends entering or exiting the apparatus. Each passage duct has a distal end configured to be connected to a high and/or low pressure connection of high and low pressure lines of a refrigeration circuit and a proximal end connected to a coolant inlet/outlet fitting. The apparatus also includes a coolant recovery and depuration pathway, and a collection container of accumulated cooling fluid that receives depurated cooling fluid from the recovery and depuration pathway.

7 Claims, 5 Drawing Sheets

DEVICE, METHOD AND KIT FOR CLEANING PASSAGE DUCTS OF A COOLANT FLUID IN A RECOVERY AND DEPURATION APPARATUS

SCOPE OF THE INVENTION

The present invention relates to a method for cleaning passage ducts of a cooling fluid in a recovery and depuration apparatus, in particular in ducts for connecting to an air conditioning system in a vehicle.

Furthermore, the present invention relates to a device for carrying out this method.

Furthermore, the invention relates to a kit for cleaning ducts which can be mounted as retrofit to existing apparatus.

DESCRIPTION OF THE TECHNICAL PROBLEM

As well known, the cooling fluid, or coolant, present in air conditioning systems, in particular those arranged on vehicles, is periodically recovered and recycled for eliminating accumulated impurities, and for testing the correct fluid amount, by means of recovery and depuration apparatus.

Air conditioning systems are known, in particular those installed on electric and hybrid vehicles, which use electric compressors. The electric compressors use exclusively a kind of lubricant called POE (Polyol Ester or Ester of polyols) indicated by the manufacturers, which has determined optimal features for such types of air conditioning systems. Instead, the use of a different lubricating fluid, for example a PAG lubricant (polyalkylene glycol) could be dangerous, since this lubricant has different physical features and among these there is electrical conductivity.

In particular, if a small amount of lubricant is accidentally or intentionally put in such a coolant circuit during the filling step, this can affect sensibly the electric insulation properties, with the result of damaging the compressor or blocking the conditioning system for safety purposes.

For this reason some car manufacturers recommend to replace the main components of the air conditioning system (evaporator, condenser and compressor) if in the system even a negligible amount of lubricant has been accidentally added different from the specific one. If this recommendation is not observed, a subsequent low value of electric insulation is detected, and an activation of a code of error is determined.

Therefore, any maintenance operation on these types of air conditioning systems that is carried out by the recovery and depuration apparatus must absolutely avoid the introduction of even small amount of lubricants different from the recommended one.

In fact, according to the operation of such recovery and depuration devices, any amount of lubricating fluid extracted during the step of recovery is replaced with specific lubricating fluid and then introduced again in the air conditioning system.

The need is felt to avoid the introduction of a non specific lubricating fluid by means of a kit for cleaning or washing the passage ducts and the corresponding fittings of the cooling fluid that are temporarily used for connecting the recovery and depuration apparatus and the conditioning system of the vehicle.

A known recovery and depuration apparatus causes the coolant liquid to enter an outer lubricant separator that is heated then by an electric resistance. Then, the coolant vapour obtained after heating enters the air conditioning system from the low pressure side (LS low side) whereas the lubricant deposits on the bottom of the separator.

However, the drawback of this apparatus is a difficulty to fill the air conditioning system in vapour phase, since the pressure balance between air conditioning system and outer lubricant separator is obtained immediately.

To overcome this drawback it is possible to turn on the air conditioning system, in order to cause the compressor causes a suction from the low pressure fitting, but this can result impossible if the air conditioning system has the only high pressure fitting (HS high side).

Furthermore, a difficulty follows from a practical viewpoint to operate on a cumbersome equipment (lubricant separator, electric resistance, electric cable for feeding the resistance) external to the recovery and depuration apparatus and the difficulty to clean or wash the lubricant separator at the end of each filling step.

Another method presently used, provides washing the coolant passage ducts. This is obtained filling the passage ducts of cooling fluid and then immediately after starting a recovery and depuration operation for a same amount of accumulated cooling fluid in the passage ducts. By repeating this step various times the lubricant present in the ducts is in part eliminated.

A drawback of this method, is that of pushing all the lubricant present in the passage ducts towards the external ends of the ducts same each time that the latter is filled with the cooling fluid. This way, it is difficult to convey back the lubricating fluid towards the inside of the machine during the recovery and depuration operation, with the consequence that the lubricant remains substantially always in the ducts, since all the times that the filling step is carried out the lubricant is pushed towards the exterior end of the ducts and not towards the interior end of the ducts that are connected to the apparatus. This effect prevents the lubricating fluid to enter the apparatus and then to be separated from the coolant and to eliminate it.

A third method adopted presently, is to replace the passage ducts which could be polluted by lubricant each time that the apparatus works on a hybrid or electric vehicle. Such method can look like the ideal solution, but the lubricant is not present only in the passage ducts but also in all the inner fittings.

In US20090188263 an apparatus is described for recovering and regenerating a cooling fluid that implements a bypass pathway that connects to each other ends 26, 30 of a first and second passage ducts 24, 28 connected to a regeneration circuit. This way, a closed circuit can be formed used for washing the ducts from residues of oil (Par[0040]).

This solution, however, cannot eliminate completely the residues of oil in the passage ducts with subsequent danger of contamination.

In particular, such a closed circuit creates a flow that entrains the residues of oil in the passage ducts towards the depuration circuit, but creates also a flow exiting from the machine that still entrains part of residues of oil bringing they back in the passage duct. This causes the passage ducts to have still some residues of oil. It can be noted, furthermore, that the fluid passage ducts have a minimum length of 2 meters, and consequently their washing through such a closed circuit is difficult and not effective.

SUMMARY OF THE INVENTION

It is then a feature of the present invention to provide a cooling fluid recovery and depuration apparatus that provides a cleaning operation of the passage ducts from the lubricating fluid.

It is also a feature of the present invention to provide a cooling fluid recovery and depuration apparatus that provides a cleaning operation of the passage ducts from the lubricating fluid in an automatic and practical way.

It is another feature of the present invention to provide a method that achieves the same objects.

It is also a feature of the present invention to provide a kit for cleaning coolant passage ducts entering or exiting a cooling fluid recovery and depuration apparatus.

These and other objects are achieved by a cooling fluid recovery and depuration apparatus, said apparatus comprising:

at least one coolant passage duct entering or exiting said apparatus having a distal end configured to be connected to a high and/or low pressure connection of a refrigeration circuit and having a proximal end configured to be connected to a coolant inlet/outlet fitting of said apparatus;

a recovery and depuration pathway for said cooling fluid;

a container for collecting accumulated cooling fluid that receives depurated cooling fluid from said recovery and depuration pathway;

a reintroduction pathway for conveying said depurated cooling fluid exiting from said collection container towards said inlet/outlet fitting, for reintroduction of depurated cooling fluid in said refrigeration circuit, a program means for operating by said apparatus an automatic suction step of cooling fluid from said refrigeration circuit, for depurating said cooling fluid with accumulation in said collection container and for reintroducing depurated cooling fluid in said refrigeration circuit;

wherein said apparatus provides a bypass pathway that connects said collection container with said distal end of said passage duct by a bypass fitting such that the flow direction of said cooling fluid drawn from said collection container enters said recovery and depuration pathway through said distal end, and wherein said program means comprises a programmed washing means arranged to recirculate said depurated cooling fluid drawn from said collection container through said bypass pathway, so that it enters said distal end and passes through said passage duct, said recovery and depuration pathway and flows in a depurated status back into said collection container, such that the flow of depurated cooling fluid washes said distal end and said passage duct.

This way, residues of lubricant can be eliminated completely that normally remain in said passage duct owing to previous recovery and depuration steps. In particular, through the bypass pathway it is possible to wash the passage duct from residues of lubricating fluid eliminating traces or residues of lubricating fluid not only in the duct but also in the proximal and distal fittings of the passage duct that are more difficult to reach. Such washing function allows using the recovery and depuration apparatus for a variety of types of vehicles that use a variety of types of lubricating fluid. For example, in case of electric and hybrid vehicles that provide the use of specific lubricating fluids with respect to the common refrigeration circuits operated by traditional engines it is possible to use the same recovery and depuration apparatus after washing the passage ducts as above described. More in particular, the washing step makes it possible to eliminate completely the risk that, in case of use of the recovery and depuration apparatus in a variety of types of vehicles that use a variety of types of lubricating fluids which are incompatible to each other that would damage the refrigeration circuit, even a small amount of lubricating fluid unsuitable for the refrigeration circuit and present in the fittings or in the passage ducts is delivered to the refrigeration circuit In particular, said apparatus comprises a first and an according to a coolant passage duct arranged to be connected according to a respective distal end to a respective fastening high and low pressure of said refrigeration circuit, said first and second passage duct having respective proximal ends arranged to be connected to a respective coolant inlet and outlet fittings of said apparatus, and wherein said bypass pathway comprises a first and a second bypass fitting configured to be connected to a respective distal end of said passage duct.

Advantageously, said bypass pathway between said collection container and said bypass fitting comprises:

a first connection duct which extends from said collection container integrated in said recovery and depuration apparatus;

a valve having an inlet port connected to said first connection duct and an outlet mouth connected to a separator means obtaining a branch exiting from said valve according to a first and a second connection branches, wherein each of said first and second connection branches comprises said bypass fitting.

In particular, said separator means is selected from the group consisting of: a T-shaped connection or a Y-shaped connection.

According to another aspect of the invention the above described objects are achieved by a method for recovering and depurating a cooling fluid comprising the steps of:

prearranging at least one coolant passage duct entering or exiting said apparatus having a distal end configured to be connected to a high and/or low pressure connection of a refrigeration circuit and having a proximal end configured to be connected to a coolant inlet/outlet fitting of said apparatus;

recovering and depurating said cooling fluid through a recovery and depuration pathway;

receiving a depurated cooling fluid from said recovery and depuration pathway in a collection container;

re-feeding said depurated cooling fluid exiting from said collection container towards said inlet/outlet fitting, for reintroduction of depurated cooling fluid in said refrigeration circuit, operating by said apparatus an automatic suction step of cooling fluid from said refrigeration circuit, for depurating said cooling fluid with accumulation in said collection container and for reintroducing depurated cooling fluid in said refrigeration circuit;

wherein the following further steps are provided:

prearranging a bypass pathway between said collection container and a bypass fitting configured to be connected to said distal end such that the flow direction of said cooling fluid drawn from said collection container enters said recovery and depuration pathway through said distal end, and operating a recirculation of said depurated cooling fluid drawn from said collection container through said bypass pathway so that it enters said distal end and passes through said passage duct, said recovery and depuration pathway and flows in a depurated status back into said collection container, such that the flow of depurated cooling fluid washes said distal end and said passage duct.

In particular, said washing step provides the steps of:

starting the washing function;

operating an automatic suction step of cooling fluid from the collection container, causing the passage of the cooling fluid in the passage ducts, depurating said cooling fluid through said recovery and depuration pathway with accumulation in the collection container, reintroducing said depurated cooling fluid in the collection container.

In particular, a step can be provided of repeating said washing step for a number of different cycles.

According to a further aspect of the invention the above described objects are achieved by a kit for cleaning coolant passage ducts entering or exiting a coolant recovery and depuration apparatus, said apparatus comprising:

at least one coolant passage duct entering or exiting said apparatus having a distal end configured to be connected to a high and/or low pressure connection of a refrigeration circuit and having a proximal end configured to be connected to a coolant inlet/outlet fitting of said apparatus;

a recovery and depuration pathway for said cooling fluid;

a container for collecting accumulated cooling fluid that receives depurated cooling fluid from said recovery and depuration pathway;

a reintroduction pathway for conveying said depurated cooling fluid exiting from said collection container towards said inlet/outlet fitting, for reintroduction of depurated cooling fluid in said refrigeration circuit, a program means for operating by said apparatus an automatic suction step of cooling fluid from said refrigeration circuit, for depurating said cooling fluid with accumulation in said collection container and for reintroducing depurated cooling fluid in said refrigeration circuit;

wherein said kit comprises:

a bypass pathway arranged to connect said collection container with said distal end of said passage duct from a bypass fitting, such that the flow direction of said cooling fluid drawn from said collection container enters said recovery and depuration pathway through said distal end, and wherein said bypass pathway is, furthermore, arranged in such a way that said depurated cooling fluid drawn from said collection container through said bypass pathway enters said distal end and passes through said passage duct, said recovery and depuration pathway and flows in a depurated status back into said collection container, such that the flow of depurated cooling fluid washes said distal end and said passage duct.

BRIEF DESCRIPTION OF THE DRAWINGS

The invention will be now shown with the following description of an exemplary embodiment thereof, exemplifying but not limitative, with reference to the attached drawings in which.

DESCRIPTION OF THE FORMS OF PREFERRED EMBODIMENT

Figure 1:
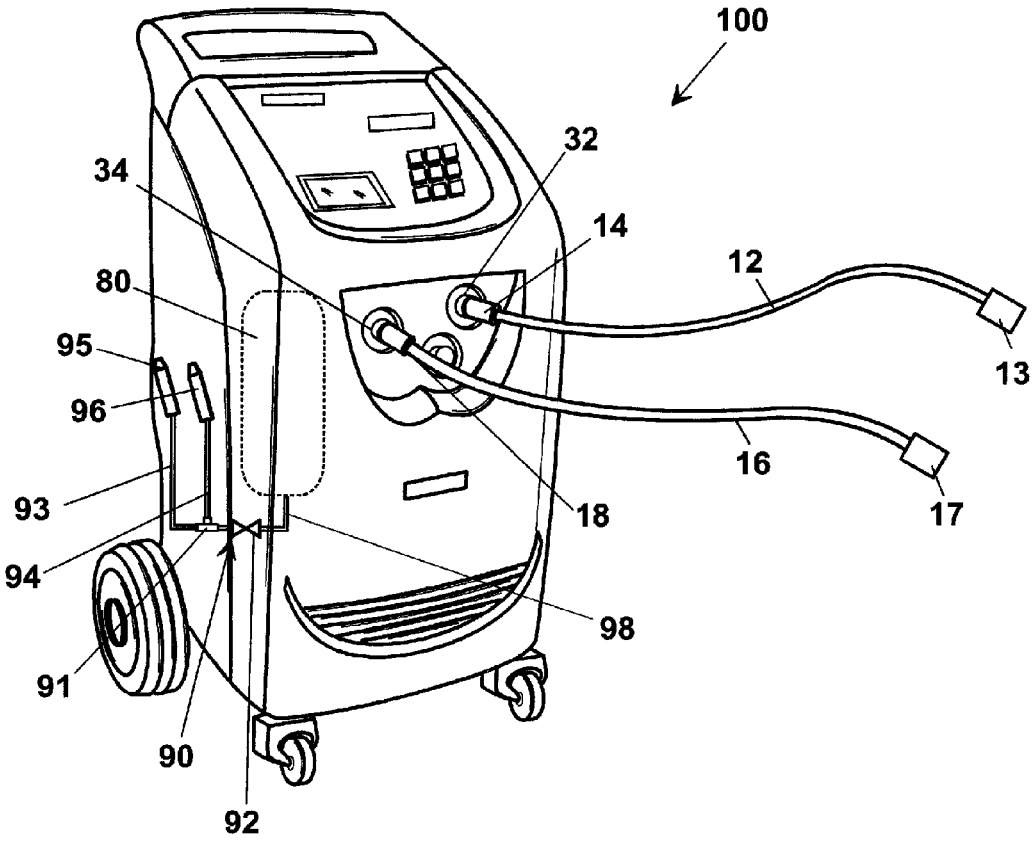
FIG. 1 shows a perspective view of a recovery and depuration apparatus of cooling fluid that allows the cleaning operation of the coolant passage ducts, according to the invention.
Figure 2:
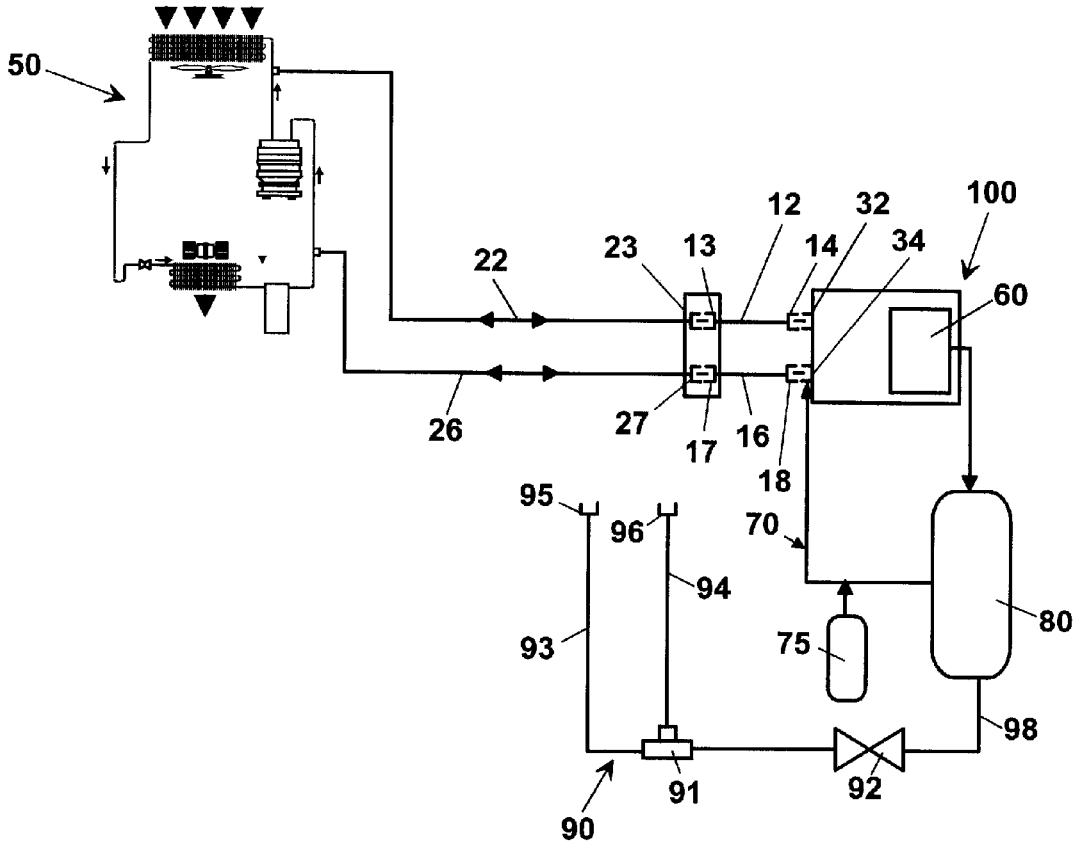
FIG. 2 shows a diagrammatical view of the apparatus of FIG. 1 connected to a refrigeration circuit of a vehicle.

With reference to FIGS. 1 and 2, an apparatus 100 is diagrammatically shown, and a method therefor is described, for recovering and depurating a cooling fluid. In particular, apparatus 100 comprises at least one coolant passage duct 12 or 16, in particular two coolant passage ducts 12, 16 that extend entering or exiting apparatus 100. In particular, each passage duct 12, 16 has a distal end 13, 17 arranged to be connected to a high and/or low pressure connection 23, 27 of respective high and low pressure lines of 22, 26 of a refrigeration circuit 50 and an proximal end 14, 18 arranged to be connected to a coolant inlet/outlet fitting 32, 34 of apparatus 100.

Figure 4:
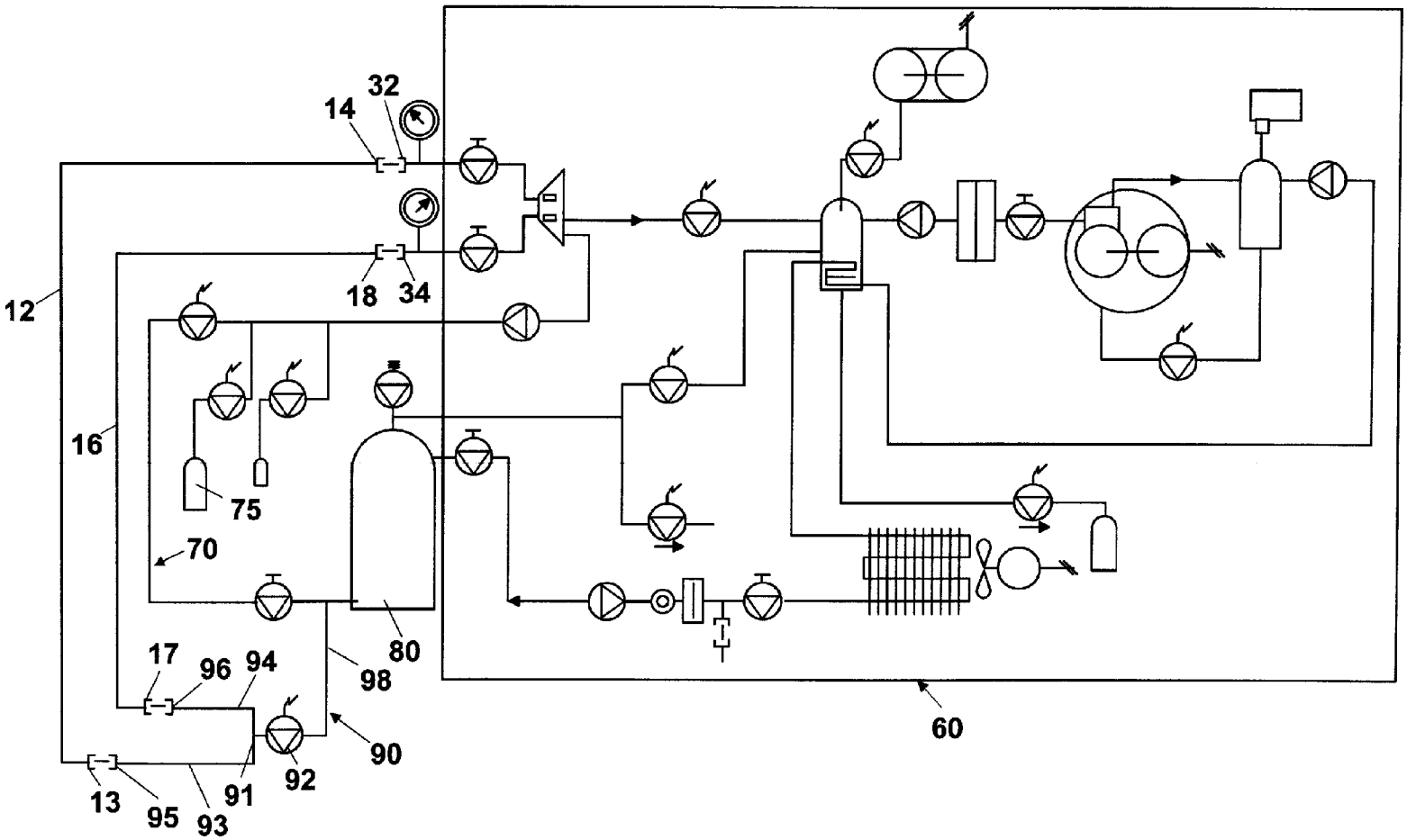
FIG. 4 shows a diagrammatical overall view of the apparatus, according to the invention.

Apparatus 100 also comprises a coolant recovery and depuration pathway 60, as shown in FIG. 4, and a coolant collection container 80 that receives depurated cooling fluid from recovery and depuration pathway 60.

At the outlet of collection container 80 a coolant reintroduction pathway 70 is provided connected to inlet/outlet fittings 32, 34, for reintroduction of depurated and enriched cooling fluid in the refrigeration circuit 50 of the vehicle always through passage ducts 12, 16.

In particular, the depurated cooling fluid at the outlet of collection container 80 is mixed with a possible amount of lubricating fluid contained in a reservoir 75, fitted to the refrigeration circuit 50 for which the step of recovery and depuration is effected.

Figure 3:
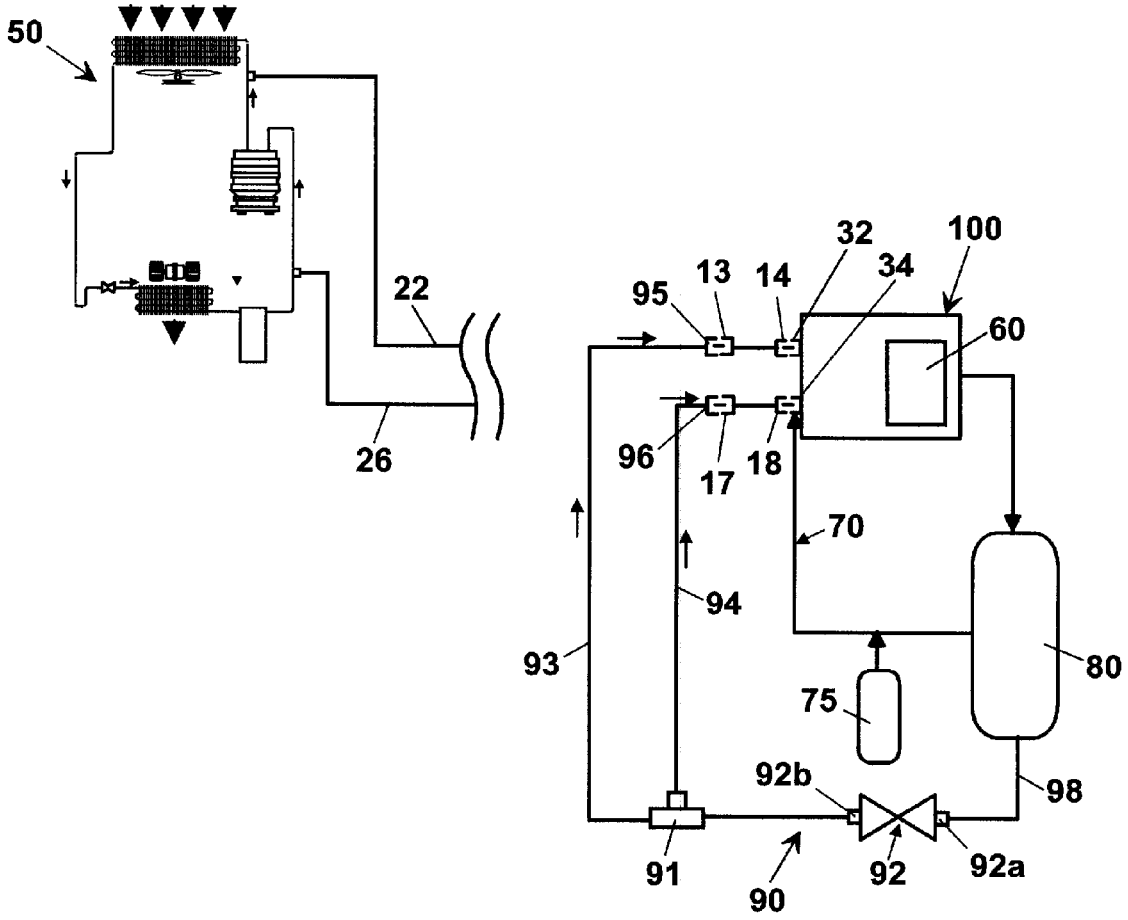
FIG. 3 shows a diagrammatical view of the apparatus of FIG. 1 in a configuration for washing the coolant passage ducts.
Figure 3A:
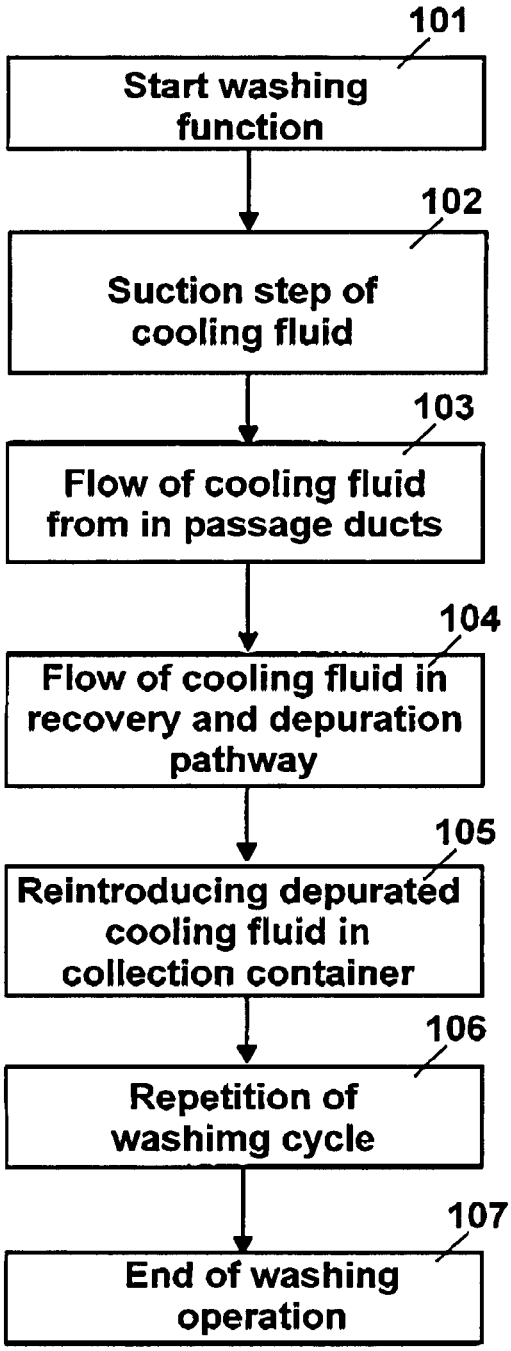
FIG. 3A shows a block diagram that describes the steps followed by programmed automatic washing means.

Through a program means provided by apparatus 100, as shown in FIG. 3A, it is possible to start then a washing function 101 that comprises operating an automatic suction step 102 of the cooling fluid from collection container 80, causing a flow 103 of cooling fluid from ducts 12, 16, for carrying out a depuration 104 of the cooling fluid and an accumulation of cooling fluid in collection container 80 and for reintroduction 105 of the depurated cooling fluid in collection container 80. Furthermore, a step can be provided of repetition 106 of the washing cycle again up to the end 107 of this step.

Apparatus 100 comprises a bypass pathway 90 between collection container 80 and a bypass fitting 95, 96, configured to be connected to the distal end 13, 17 of passage duct 12, 16.

Furthermore, apparatus 100 provides programmed washing means arranged to recirculate the cooling fluid, drawn from container 80 through respectively the ducts of bypass pathway 90, passage ducts 12, 16 and recovery and depuration pathway up to reach again collection container 80, when the respective distal ends 13, 17 are connected to bypass fittings 95, 96, in order to form with apparatus 100 a closed circuit.

In particular, the cooling fluid flow drawn by collection container 80 has a flow direction towards recovery and depuration pathway 60 in order to wash passage ducts 12, 16 and push or convey the residues of oil in it present towards the recovery and regeneration pathway where they are treated and depurated. This way, residues of lubricant or other dust that normally remain in passage ducts 12, 16 can be eliminated completely, owing to the previous recovery and depuration steps. In other words, the unidirectional circulation, with at least one passage of cooling fluid from collection container 80 through passage ducts 12, 16 into recovery and depuration pathway 60 causes a washing effect for all the length of passage ducts 12, 16 washing away the residues of oil with clean cooling fluid, in order to remove them.

It can be noted that the passage ducts have a length set from a minimum of 2 meters up to 3 meters or more.

In addition, through bypass pathway 90 it is possible eliminate traces or residues of lubricating fluid not only in passage duct 12, 16 but also in proximal fittings 14, 18 and distal fittings 13, 17 of passage ducts that are more difficult to reach.

In particular, as shown in FIGS. 3 and 4, bypass pathway 90, which is arranged between collection container 80 and bypass fittings 95, 96, comprises a first connection duct 98 that extends from collection container 80; this, as shown in FIG. 1, is integrated in the recovery and depuration apparatus. Furthermore, it comprises a valve 92 having an inlet port 92*a* connected to the first connection duct 98 and an outlet mouth 92*b* connected to a separator means 91 obtaining a branch at the outlet of valve 92 according to first 93 and second 94 connection branches. Each first 93 and second 94 connection branch comprises a respective bypass fitting 95, 96. In an exemplary embodiment of FIGS. 3 and 4, the separator means 91 comprises a T-shaped connection.

Such a bypass washing pathway makes it possible to eliminate completely possible residues of lubricant in passage ducts 12, 16 as well as in the connection parts of the apparatus.

In other words by operating the washing function through a dedicated starting key, the cooling fluid present in collection container 80 carries out at least one depuration cycle in the same apparatus, thus allowing to obtain passage ducts 12, 16 and fittings completely cleaned from residues of lubricant or other dust that has been deposited when the apparatus, connected to the vehicle, carries out the recovery and depuration cycles.

According to another aspect of the invention, furthermore, a kit is provided to be mounted as retrofit for creating in the already existing apparatus bypass pathway 90 that allows washing ducts 12, 16.

In particular, the kit comprises a connection duct 98 configured to be connected to collection container 80 or to a duct near collection container 80, a valve 92 connected to connection duct 98 and a first 93 and second 95 connection branches which extend at the outlet of valve 92 by a T-shaped connection or a Y-shaped connection 91. Each first 93 and second 94 connection branches comprises a respective bypass fitting 95, 96. In particular, the kit can be mounted as retrofit and does not involve an increase of size, but can be easily integrated in existing depuration apparatus.

Such washing function allows using the recovery and depuration apparatus for a variety of types of vehicles that use a variety of types of lubricating fluid. For example, in case of electric and hybrid vehicles that provide the use of specific lubricating fluids with respect to the common refrigeration circuits of traditional vehicles, it is possible to use the same recovery and depuration apparatus after washing the passage ducts as above described. More in particular, the washing reduces and eliminates completely the risk that, in case of use of the recovery and depuration apparatus in a variety of types of vehicles that use a variety of types of lubricating fluids which are incompatible to each other that would cause the problem of the refrigeration circuit, even a small amount of lubricating fluid unsuitable for the refrigeration circuit and present in the fittings or in the passage ducts of the lubricating fluid is delivered to the refrigeration circuit.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

The invention claimed is:

1. A method for recovering and depurating a coolant comprising the steps of:

prearranging at least one passage duct of said coolant entering or exiting an apparatus having a distal end configured to be connected to a high and/or low pressure connection of a refrigeration circuit, said passage duct having a proximal end connected to an inlet fitting and/or an outlet fitting of said apparatus;

recovering said coolant by suction from said refrigeration circuit and depurating said coolant through a recovery and depuration pathway;

receiving a depurated coolant from said recovery and depuration pathway in a collection container;

reintroducing said depurated coolant through a reintroduction pathway between said collection container and said inlet fitting and/or said outlet fitting into said refrigeration circuit;

prearranging a bypass pathway that branches off from said reintroduction pathway, said bypass pathway comprising a bypass fitting which can fit with said distal end of said passage duct, arranging said passage duct in a recirculation configuration, in which said distal end is connected to said bypass fitting and said proximal end is connected to said inlet or outlet fitting; and operating a recirculation of said depurated coolant drawn from said collection container through said bypass pathway so that said depurated coolant enters said distal end and passes through said passage duct from said recovery and depuration pathway up to said collection container, washing impurities from said distal end and said passage duct and being depurated again.

2. The method according to claim 1, wherein said recirculating step comprises:

starting a washing function;

operating an automatic coolant suction step from the collection container;

causing the passage of the coolant in the passage ducts;

depurating said coolant through said recovery and depuration pathway with accumulation in said collection container; and reintroducing said depurated coolant in said collection container.

3. An apparatus for depuration of a cooling fluid, said apparatus comprising:

at least one coolant passage duct entering or exiting said apparatus having a distal end configured to be connected to a high and/or low pressure connection of a refrigeration circuit and having a proximal end which is configured to be connected to an inlet fitting and/or to an outlet fitting for said coolant;

a recovery and depuration pathway for said coolant;

a collection container configured to receive depurated coolant from said recovery and depuration pathway;

a reintroduction pathway between said collection container and said inlet fitting and/or outlet fitting for reintroduction of depurated coolant into said refrigeration circuit;

a program means configured to operate said apparatus for carrying out the following steps: an automatic suction of said coolant from said refrigeration circuit, a depuration of said coolant with accumulation in said collection container, and a reintroduction of said depurated coolant into said refrigeration circuit;

wherein said apparatus provides a bypass pathway that branches off from said reintroduction pathway, said bypass pathway comprising a bypass fitting, which can fit with said distal end of said passage duct, in such a way that said passage duct can be arranged in a recirculation configuration, in which said distal end is connected to said bypass fitting and said proximal end is connected to said inlet or outlet fitting, such that a depurated coolant is able to be drawn from said collection container to flow towards said recovery and depuration pathway through said distal end and said passage duct; and wherein a programmed washing means is provided that is configured, when said passage duct is in said recirculation configuration, to cause said depurated coolant, that is drawn from said collection container, to recirculate through said passage duct via said bypass pathway and said bypass fitting, and then through said recovery and depuration pathway up to said collection container, such that said depurated coolant washes impurities from said distal end and said passage duct and is depurated again.

4. The apparatus of claim 3, further comprising:

a first and a second passage duct for said coolant configured to be connected at a respective distal end to a high pressure connection and a low pressure connection of said refrigeration circuit;

wherein said first and second passage ducts comprise proximal ends configured to be connected to at least one of an inlet fitting and an outlet fitting;

wherein said bypass pathway comprises a first and a second bypass fitting configured to be connected to a respective distal end of said passage duct.

5. The apparatus of claim 3, wherein said bypass pathway between said collection container and said bypass fitting comprises:

a first connection duct that extends from said collection container integrated in said apparatus;

a valve having an inlet port connected to said first connection duct and an outlet mouth connected to a Y-shaped or T-shaped connection obtaining a branch exiting from said valve according to first and second connection branches, wherein each of said first and second connection branches comprises a respective bypass fitting.

6. In combination, a depuration apparatus and kit for cleaning coolant passage ducts entering or exiting a coolant recovery and the depuration apparatus;

wherein said depuration apparatus comprises:

at least one passage duct of coolant entering or exiting said apparatus having a distal end configured to be connected to a high and/or low pressure connection of a refrigeration circuit and having a proximal end configured to be connected to an inlet fitting and/or an outlet fitting for the coolant;

a recovery and depuration pathway for said coolant;

a collection container of coolant that receives depurated coolant from said recovery and depuration pathway;

a reintroduction pathway, between said collection container and said inlet fitting and/or outlet fitting, for reintroducing said depurated coolant exiting from said collection container towards said inlet fitting and/or outlet fitting into said refrigeration circuit;

a program means configured to operate the following steps: an automatic suction of said coolant from said refrigeration circuit, a depuration of said coolant with accumulation in said collection container, and a reintroduction of said depurated coolant into said refrigeration circuit;

wherein said kit comprises a bypass pathway that branches off from said reintroduction pathway, said bypass pathway comprising a bypass fitting which can fit with said distal end of said passage duct, in such a way that said passage duct can be arranged in a recirculation configuration, in which said distal end is connected to said bypass fitting and said proximal end is connected to said inlet or outlet fitting, such that depurated coolant can flow from said collection container through said distal end and said passage duct towards said recovery and depuration pathway up to said collection container, and such that said depurated coolant washes impurities from said distal end and said passage duct and is depurated again.

7. The method of claim 2, wherein said washing step is repeated.

* * * * *